US011732914B2

(12) United States Patent
Mergener et al.

(10) Patent No.: US 11,732,914 B2
(45) Date of Patent: Aug. 22, 2023

(54) GRILLE ATTACHMENT FEATURE FOR A VENTILATION SYSTEM

(71) Applicant: Broan-NuTone LLC, Hartford, WI (US)

(72) Inventors: Bradley Mergener, Hartford, WI (US); Rick Sinur, Hartford, WI (US); Ryan Revers, Hartford, WI (US)

(73) Assignee: Broan-NuTone LLC, Hartford, WI (US)

( * ) Notice: Subject to any disclaimer, the term of this patent is extended or adjusted under 35 U.S.C. 154(b) by 0 days.

(21) Appl. No.: 17/689,044

(22) Filed: Mar. 8, 2022

(65) Prior Publication Data

US 2022/0275954 A1 Sep. 1, 2022

Related U.S. Application Data

(62) Division of application No. 16/777,012, filed on Jan. 30, 2020, now Pat. No. 11,300,305.

(60) Provisional application No. 62/806,236, filed on Feb. 15, 2019.

(51) Int. Cl.
*F24F 7/013* (2006.01)
*F24F 13/08* (2006.01)

(52) U.S. Cl.
CPC ..... *F24F 7/013* (2013.01); *F24F 13/084* (2013.01)

(58) Field of Classification Search
CPC ..... F24F 7/013; F24F 13/082; F24F 13/084; F24F 13/078; F24F 2007/001
USPC ..... 454/330, 331, 332, 341, 349
See application file for complete search history.

(56) References Cited

U.S. PATENT DOCUMENTS

| | | | |
|---|---|---|---|
| 1,030,028 | A | 6/1912 | Stampahar et al. |
| 1,395,833 | A | 11/1921 | Kling et al. |
| 1,532,635 | A | 4/1925 | Osbun |
| 1,713,101 | A | 5/1929 | Starrett |
| 1,886,841 | A | 11/1932 | Searles |
| 1,895,642 | A | 1/1933 | Preble |
| 1,941,450 | A | 1/1934 | Sylvan |
| 2,019,867 | A | 11/1935 | Lutillus |
| 2,021,086 | A | 11/1935 | Oskamp |
| D107,399 | S | 12/1937 | Broadwin |
| 2,108,283 | A | 2/1938 | Drew et al. |
| D109,887 | S | 5/1938 | Fordyce |
| 2,182,690 | A | 12/1939 | Cole |
| D118,359 | S | 1/1940 | Arenberg |
| D120,266 | S | 4/1940 | Fischer |
| D120,772 | S | 5/1940 | Arenberg |
| D120,773 | S | 5/1940 | Arenberg |
| 2,220,127 | A | 11/1940 | Slayter |
| 2,222,081 | A | 11/1940 | Leigh |

(Continued)

OTHER PUBLICATIONS

Emerson Environment Products, Whole House Fan and Shutter System Owners Manual, Dec. 1982, (12 pages).

(Continued)

*Primary Examiner* — Vivek K Shirsat
(74) *Attorney, Agent, or Firm* — Barnes & Thornburg LLP

(57) ABSTRACT

A ventilation system includes a main housing defining an internal region and a blower contained within the internal region. The ventilation system is positioned adjacent to a room of a building structure and is configured to draw air out of the room to provide ventilation. The ventilation system further includes a grille secured relative to the main housing using an attachment feature.

20 Claims, 8 Drawing Sheets

(56) References Cited

U.S. PATENT DOCUMENTS

D126,128 S 3/1941 Eallman
2,240,617 A 5/1941 Harrigan
2,278,581 A 4/1942 MacDougald
D132,865 S 6/1942 Drollinger
2,325,657 A 8/1943 Burkness
D153,313 S 4/1949 Phillips
2,472,748 A 6/1949 Labus
2,483,377 A 9/1949 Young
D157,014 S 1/1950 Walker
2,576,860 A 11/1951 Shapiro
D165,982 S 2/1952 Kennedy
D166,324 S 4/1952 Kurth
D171,505 S 2/1954 Krueger
2,668,491 A 2/1954 Gerlitz
2,673,514 A 3/1954 Hanks
D173,120 S 9/1954 Levenhagen
2,689,906 A 9/1954 Corbett
2,697,163 A 12/1954 Spear
2,710,573 A 6/1955 Marker
2,780,981 A 2/1957 Miller
2,790,375 A 4/1957 Broberg
2,799,213 A 7/1957 Hansen
2,800,069 A 7/1957 Smith
D180,727 S 8/1957 Bourner
2,811,094 A 10/1957 Auer
2,824,429 A 2/1958 Zucker
2,831,550 A 4/1958 Bub
D183,117 S 7/1958 Coleman
2,875,678 A 3/1959 Shepherd
2,911,900 A 11/1959 Emil
2,939,377 A 6/1960 Stach
2,963,956 A 12/1960 Hill
2,987,258 A 6/1961 North
2,996,972 A 8/1961 Johansson
3,001,056 A 9/1961 Spear
3,002,676 A 10/1961 Papsdorf
D192,312 S 2/1962 Hart
3,028,475 A 4/1962 Nash
3,045,579 A 7/1962 Jenn et al.
D193,868 S 10/1962 Bloomfield
3,064,548 A 11/1962 Field
3,064,550 A * 11/1962 O'Day ..... F24F 13/075
454/301
3,068,341 A 12/1962 Ortiz et al.
3,075,335 A 1/1963 Bandlow
3,097,287 A 7/1963 Knoll et al.
3,101,662 A 8/1963 Alldritt
D196,618 S 10/1963 Hammes
D199,045 S 9/1964 Everts
3,211,080 A 10/1965 Rader
3,212,425 A 10/1965 Hazen et al.
3,215,828 A 11/1965 Bonvallet et al.
3,249,037 A 5/1966 Stalker
3,250,063 A 5/1966 Andrews
3,276,597 A 10/1966 Mesek et al.
3,326,112 A 6/1967 Sadlow et al.
3,332,334 A 7/1967 Melzer
3,347,025 A 10/1967 Wiley
3,391,689 A 7/1968 Roger
3,438,180 A 4/1969 Klouda
3,460,322 A 8/1969 Rivers et al.
3,572,234 A 3/1971 Schoenthaler
3,577,710 A 5/1971 Feldman
3,606,593 A 9/1971 Steiner
3,630,007 A 12/1971 Neumann
3,636,306 A 1/1972 Bumpus
3,665,838 A 5/1972 Shepherd
3,692,977 A 9/1972 Duhamel et al.
3,698,833 A 10/1972 Cann et al.
3,732,030 A 5/1973 Mullings
3,743,439 A 7/1973 Cann
D229,181 S 11/1973 Bledsoe
3,777,650 A 12/1973 Wenig
3,785,271 A 1/1974 Joy
3,788,207 A 1/1974 Doherty
3,861,894 A 1/1975 Marsh
3,875,678 A 4/1975 Vits
3,926,537 A 12/1975 Piper
3,952,638 A 4/1976 Felter et al.
D244,764 S 6/1977 Grubauer
D244,854 S 6/1977 Salamone
4,073,597 A 2/1978 Barnhart et al.
4,115,082 A 9/1978 Newell
4,141,703 A 2/1979 Mulchi
4,203,332 A 5/1980 Corsetti
D256,047 S 7/1980 Wormington
D257,060 S 9/1980 Mann
D258,083 S 1/1981 Gammell
4,252,547 A 2/1981 Johnson
D261,803 S 11/1981 Bohanon
D262,457 S 12/1981 Swales
4,319,898 A 3/1982 Maierhofer
4,335,647 A 6/1982 Timmons
4,336,749 A 6/1982 Barnhart et al.
D267,828 S 2/1983 Cohen
D268,952 S 5/1983 Anderson
4,382,440 A 5/1983 Kapp et al.
4,385,550 A 5/1983 Steiner et al.
4,385,911 A 5/1983 Popeil et al.
4,406,216 A 9/1983 Hott et al.
D271,984 S 12/1983 Nelson et al.
D275,988 S 10/1984 Walker
D276,282 S 11/1984 Burg
D277,298 S 1/1985 Nelson
D277,299 S 1/1985 Nelson
4,510,851 A 4/1985 Sarnosky et al.
D282,275 S 1/1986 Price
D282,972 S 3/1986 Castor et al.
4,594,940 A 6/1986 Wolbrink et al.
4,610,705 A 9/1986 Sarnosky et al.
D286,446 S 10/1986 Caroli et al.
4,628,802 A 12/1986 Steiner et al.
D287,888 S 1/1987 Castor et al.
D288,007 S 1/1987 Jonas et al.
D288,396 S 2/1987 Ritman
4,681,024 A 7/1987 Ivey
4,722,266 A 2/1988 Deckert
D295,675 S 5/1988 Demarest
4,754,697 A 7/1988 Asselbergs
4,776,798 A 10/1988 Crawford
D300,777 S 4/1989 Bales et al.
D300,847 S 4/1989 Lin
4,862,334 A 8/1989 Ivey et al.
D303,436 S 9/1989 Clyde-Mason
4,867,640 A 9/1989 Penlesky et al.
4,991,496 A 2/1991 Kuno et al.
D315,790 S 3/1991 Koessler
D322,667 S 12/1991 Fukuda et al.
D323,209 S 1/1992 Fukumoto et al.
D323,554 S 1/1992 Hoyt et al.
D325,434 S 4/1992 Dosmann
D325,651 S 4/1992 Sonneman
D328,650 S 8/1992 Jones
D330,585 S 10/1992 Saito et al.
D331,458 S 12/1992 Saito et al.
D331,638 S 12/1992 Vamberszky et al.
D334,053 S 3/1993 Cook
5,197,920 A 3/1993 Ganse
D334,977 S 4/1993 Avari
D336,895 S 6/1993 Rogov
D338,954 S 8/1993 Brock
D340,109 S 10/1993 Julien
D341,442 S 11/1993 Shapiro
5,319,942 A 6/1994 Paustian et al.
D349,778 S 8/1994 Johnson et al.
D350,191 S 8/1994 Tsuji
5,333,830 A 8/1994 Millen
D350,409 S 9/1994 Johnson et al.
D352,564 S 11/1994 Marischen
D357,732 S 4/1995 Spechts et al.
D361,375 S 8/1995 Gallagher et al.
D362,059 S 9/1995 Wojcik
D366,521 S 1/1996 Wijaranakula
D366,522 S 1/1996 Lagace et al.

(56) References Cited

U.S. PATENT DOCUMENTS

| | | | |
|---|---|---|---|
| D367,924 | S | 3/1996 | Patel et al. |
| D372,767 | S | 8/1996 | Borges |
| D372,775 | S | 8/1996 | Schuler |
| D374,927 | S | 10/1996 | Chabot |
| D375,350 | S | 11/1996 | Patel et al. |
| D376,214 | S | 12/1996 | Pinchuk |
| D376,639 | S | 12/1996 | Moore |
| D376,842 | S | 12/1996 | Franklin et al. |
| D377,535 | S | 1/1997 | Shulman |
| 5,601,485 | A | 2/1997 | Gigola |
| D378,698 | S | 4/1997 | Ukai et al. |
| 5,632,334 | A | 5/1997 | Grinbergs et al. |
| D382,549 | S | 8/1997 | Yoshimoto |
| D386,186 | S | 11/1997 | Schnetzer et al. |
| D386,209 | S | 11/1997 | Firestone et al. |
| D387,859 | S | 12/1997 | Ukai et al. |
| D388,353 | S | 12/1997 | Desborough et al. |
| D393,708 | S | 4/1998 | Assadi |
| D395,494 | S | 6/1998 | Becker |
| D396,275 | S | 7/1998 | Pearson |
| D398,417 | S | 9/1998 | Fritzsche et al. |
| 5,820,247 | A | 10/1998 | Schuler |
| D401,682 | S | 11/1998 | Galeazzi et al. |
| D403,442 | S | 12/1998 | Joss |
| D403,787 | S | 1/1999 | Van Belle |
| D404,508 | S | 1/1999 | Marischen |
| D405,207 | S | 2/1999 | Mora |
| D407,473 | S | 3/1999 | Wimbock |
| D407,521 | S | 3/1999 | Crosby |
| 5,879,232 | A | 3/1999 | Luter et al. |
| D409,449 | S | 5/1999 | Cornelissen |
| 5,918,972 | A | 7/1999 | Van Belle |
| D412,566 | S | 8/1999 | Taras et al. |
| D414,253 | S | 9/1999 | Kobayashi et al. |
| 5,971,847 | A | 10/1999 | Webb |
| D416,315 | S | 11/1999 | Nanjo |
| D416,349 | S | 11/1999 | Pahl |
| D417,307 | S | 11/1999 | Pahl |
| D418,909 | S | 1/2000 | Mockett |
| D420,121 | S | 2/2000 | Felix-Flender |
| 6,027,406 | A | 2/2000 | Yazici |
| D424,672 | S | 5/2000 | Nanjo |
| D425,974 | S | 5/2000 | Esty et al. |
| D426,124 | S | 6/2000 | Kassalen et al. |
| D426,292 | S | 6/2000 | Nanjo |
| D426,657 | S | 6/2000 | Joss |
| D427,009 | S | 6/2000 | Iyengar et al. |
| D427,303 | S | 6/2000 | Brown |
| D428,645 | S | 7/2000 | Rossman et al. |
| 6,227,962 | B1 | 5/2001 | Orendorff |
| 6,261,175 | B1 | 7/2001 | Larson et al. |
| 6,464,579 | B1 | 10/2002 | Salazar |
| 6,488,579 | B2 | 12/2002 | Larson et al. |
| 6,503,060 | B1 | 1/2003 | Kamada et al. |
| 6,537,146 | B1 | 3/2003 | Haynes |
| 6,651,454 | B1 | 11/2003 | Spiegel |
| 6,653,566 | B2 | 11/2003 | Petak et al. |
| 6,723,428 | B1 | 4/2004 | Foss et al. |
| 6,750,760 | B2 | 6/2004 | Albritton et al. |
| 6,889,948 | B2 | 5/2005 | Melancon et al. |
| 6,979,169 | B2 | 12/2005 | Penlesky et al. |
| 7,203,416 | B2 | 4/2007 | Craw et al. |
| 7,328,478 | B2 | 2/2008 | Jenkins |
| 7,537,647 | B2 | 5/2009 | Adair et al. |
| 7,581,717 | B1 | 9/2009 | Thurlkill |
| 7,596,960 | B2 | 10/2009 | Bae |
| D618,782 | S | 6/2010 | Zakula et al. |
| D626,644 | S | 11/2010 | Jacak et al. |
| 7,850,513 | B1 | 12/2010 | Parker et al. |
| D635,238 | S | 3/2011 | Zakula et al. |
| D653,323 | S | 1/2012 | Jacak et al. |
| D654,998 | S | 2/2012 | Zakula et al. |
| D655,403 | S | 3/2012 | Zakula et al. |
| D665,225 | S | 8/2012 | Zakula et al. |
| 8,256,241 | B2 | 9/2012 | Ikeda et al. |
| D678,995 | S | 3/2013 | Hoshino et al. |
| D701,952 | S | 4/2014 | Hoshino et al. |
| D706,916 | S | 6/2014 | Penlesky et al. |
| 8,864,447 | B1 | 10/2014 | Humphrey |
| 9,022,846 | B1 | 5/2015 | Tom |
| 9,028,212 | B1 * | 5/2015 | Tom ..... F04D 25/12 416/5 |
| 9,103,104 | B1 | 8/2015 | Tom |
| 9,131,814 | B2 | 9/2015 | Nakamura et al. |
| 9,182,138 | B2 | 11/2015 | Foreman et al. |
| 9,188,132 | B1 | 11/2015 | Tom |
| 9,212,668 | B2 | 12/2015 | Deng et al. |
| 9,303,859 | B2 | 4/2016 | Horng et al. |
| 9,303,888 | B2 | 4/2016 | Karst et al. |
| D759,800 | S | 6/2016 | Adrian et al. |
| D778,424 | S | 2/2017 | Jonas et al. |
| D778,425 | S | 2/2017 | Jonas et al. |
| D779,050 | S | 2/2017 | Jonas et al. |
| D784,511 | S | 4/2017 | Jonas et al. |
| D784,512 | S | 4/2017 | Jonas et al. |
| D799,677 | S | 10/2017 | Jonas et al. |
| D799,678 | S | 10/2017 | Jonas et al. |
| D799,679 | S | 10/2017 | Jonas et al. |
| D800,294 | S | 10/2017 | Jonas et al. |
| D800,295 | S | 10/2017 | Jonas et al. |
| D800,892 | S | 10/2017 | Jonas et al. |
| D815,724 | S | 4/2018 | Jonas et al. |
| D816,206 | S | 4/2018 | Jonas et al. |
| D822,821 | S | 7/2018 | Jonas et al. |
| D837,966 | S | 1/2019 | Adrian et al. |
| D842,449 | S | 3/2019 | Chang et al. |
| 2013/0088855 | A1 | 4/2013 | Ye |
| 2015/0117034 | A1 | 4/2015 | Horng |
| 2015/0125292 | A1 | 5/2015 | Karst |
| 2016/0069561 | A1 | 3/2016 | Jonas |

OTHER PUBLICATIONS

Photographs of Panasonic Ventilating Fan, Model FV-11, VHL1, available prior to Jan. 2, 2008, (3 pages).

Spartan Electric Company, Direct Drive Whole House Fans Publication, available prior to Jan. 2, 2008 (4 pages).

"Whirpool 30 and 36 Range Hood Models UXT3030AY/UXT3036AY." Installation Instructions and Use & Care Guide, [online], Retrieved from the Internet: <http://www.whirlpool.ca/digitalassests/UXT3030AYB/US%20and%20Care_EN.pdf>, 2011 (28 pages).

"Maytag 30 in. Non-Vented Range Hood in Stainless Steel," Model# UXT4030AYS, Home Depot, [online], Retrieved from the Internet on Sep. 23, 2013: <http://www.homedepot.com/p/Maytag-30-in-Non-Vented-Range-Hood-in-Stainless-Steel-UXT 4030AYS/202832999#customer_reviews>, (7 pages).

"Finnleo Steam Sauna Ventilation Wood Grill," online, Retrieved from the Internet: <https://www.tineye.com/search/8ff8db465e46f58bcad482160583c- b539dc23fa4/, Jun. 6, 2012 (3 pages).

U.S. Appl. No. 11/968,250 Non Final Office Action dated Sep. 20, 2012 (21 pages).

U.S. Appl. No. 11/968,250, Response filed Dec. 20, 2012 to Non-Final Office Action dated Sep. 20, 2012 (26 pages).

U.S. Appl. No. 11/968,250, Non Final Office Action dated Mar. 26, 2013 (20 pages).

U.S. Appl. No. 11/968,250, Response filed May 24, 2013 to Final Office Action dated Mar. 26, 2013 (34 pages).

U.S. Appl. No. 11/968,250, Advisory Action dated Jun. 24, 2013 (3 pages).

U.S. Appl. No. 11/968,250, Non Final Office Action dated Aug. 22, 2013 (18 pages).

U.S. Appl. No. 29/458,592, Non Final Office Action dated Sep. 27, 2013 (7 pages).

U.S. Appl. No. 11/968,250, Response filed Nov. 8, 2013 to Non Final Office Action dated Aug. 22, 2013 (23 pages).

Grille Images, image post date Nov. 23, 2013, site visited May 14, 2016, [online], <https://www.tineye.com/search/ea95b48bdc1fce15b6d68e4fbe33c- 0e4e7566460/> (7 pages).

(56) References Cited

OTHER PUBLICATIONS

U.S. Appl. No. 29/458,592, Response filed Dec. 27, 2013 to Non Final Office Action dated Sep. 27, 2013 (8 pages).
U.S. Appl. No. 11/968,250, Final Office Action dated Jan. 22, 2014 (18 pages).
U.S. Appl. No. 29/458,592, Notice of Allowance dated Mar. 4, 2014 (6 pages).
Napoleon Prestige Pro 450-Natural Gas, image post date Apr. 5, 2014, site visited May 15, 2016, [online], <http://web.archive.org/web/20140405111728/http://www.bbqworld.co.uk/n- apoleon/napoleon-prestige-pro-450-natural-gas.asp> (2 pages).
"Ultra Green Series," [online], Retrieved from Internet: <http://web.archive.org/web/20140416053348/http://www.broan com/products/filter/ultra-406c-abf1-ed72241eb706>, Apr. 16, 2014 (2 pages).
"Airvent 435103 Kitchen Extractor Fan," [online], Retrieved from Internet: <https://www.amazon.co.uk/Airvent-435103-Kitchen-Extractor-1-50mm/dp/B0085TQ75U/ref=pd.sub.--cp.sub.--107.sub-3?ie=UTF8&refRID=1MXRP1-21QR5H6NZ1MR7C., May 14, 2014 (5 pages).
U.S. Appl. No. 11/968,250, Response filed May 22, 2014 to Final Office Action dated Jan. 22, 2014 (12 pages).
U.S. Appl. No. 11/968,250, Non Final Office Action dated Jun. 19, 2014 (18 pages).
U.S. Appl. No. 11/968,250, Response filed Sep. 19, 2014 to Non Final Office Action dated Jun. 19, 2014, (11 pages).
Air Vent Grille Cover, image post date Nov. 9, 2014, site visited May 14, 2016, [online], <https://www/tineye.com/Search/232b8f674998285163e7a3de47a03ed0ef9b1dc- 6/> (4 pages).
U.S. Appl. No. 11/968,250, Final Office Action dated Nov. 26, 2014 (20 pages).
"Manrose FF100P Bathroom Fan," [online], Retrieved from Internet: <https://www.tineye/com/Search63988ff8b950dad9cb1aaec51119050bdd00cf2- 1/?pluginver=>, Dec. 12, 2014 (4 pages).
U.S. Appl. No. 29/458,589, Restriction Requirement dated Apr. 9, 2015 (7 pages).
U.S. Appl. No. 29/458,589, Response filed Apr. 27, 2015 to Restriction Requirement dated Apr. 9, 2015 (4 pages).
Canadian Application No. 169,274, Office Action dated Oct. 25, 2016 (2 pages).
Canadian Application No. 167,117, Response filed Nov. 3, 2016 to Office Action dated Jul. 14, 2016 (10 pages).
Canadian Application No. 163,019, Office Action dated Nov. 13, 2015 (2 pages).
Canadian Application No. 163,015, Office Action dated Dec. 15, 2015 (7 pages).
Canadian Application No. 163,016, Office Action dated Dec. 16, 2015 (2 pages).
U.S. Appl. No. 29/521,663, Restriction Requirement dated Dec. 3, 2015 (6 pages).
U.S. Appl. No. 29/521,663, Response filed Feb. 2, 2016 to Restriction Requirement dated Dec. 3, 2015 (10 pages).
U.S. Appl. No. 29/521,663, Notice of Allowance dated Feb. 12, 2016 (7 pages).
Canadian Application No. 165,307, Office Action dated Feb. 22, 2016 (4 pages).
Canadian Application No. 165,355, Response filed Jun. 15, 2016 to Office Action dated Feb. 15, 2016 (6 pages).
Canadian Application No. 163,017, Response filed Mar. 9, 2016 to Office Action dated Nov. 9, 2015 (8 pages).
Canadian Application No. 163,018, Response filed Mar. 9, 2016 to Office Action dated Nov. 9, 2015 (7 pages).
Canadian Application No. 163,019, Response filed Mar. 9, 2016 to Office Action dated Nov. 9, 2015 (7 pages).
Canadian Application No. 165,015, Response filed Mar. 10, 2016 to Office Action dated Nov. 10, 2015 (7 pages).
U.S. Appl. No. 29/514,061, Response filed Aug. 17, 2016 to Non Final Office Action dated May 19, 2016 (6 pages).
U.S. Appl. No. 29/514,061, Non Final Office Action dated May 19, 2016 (19 pages).
U.S. Appl. No. 29/514,061, Response filed Nov. 21, 2016 to Final Office Action dated Sep. 19, 2016 (16 pages).
U.S. Appl. No. 29/514,061 Final Office Action dated Sep. 19, 2016 (9 pages).
U.S. Appl. No. 29/514,063 Non Final Office Action dated May 19, 2016 (22 pages).
Canadian Application No. 165,366 Office Action dated Feb. 23, 2016 (4 pages).
Canadian Application No. 165,366 Response filed Jun. 15, 2016 to Office Action dated Feb. 15, 2016 (18 pages).
Chinese Application No. 201630055109.5, Office Action dated Jun. 1, 2016 (3 pages).
Chinese Application No. 201630055109.5, Response filed Sep. 18, 2016 to Office Action dated Jun. 1, 2016 (8 pages).
Broan QTX110SL Media Gallery, Broan QTX110SL Combination Fan, Light, Night-Light, 110 CFM, 0.9 Sones, Humidity Sensing, ventingdirect.com (1 page).
Admitted Prior Art NuTone 791LEDNT Fan/Light (6 pages).
U.S. Appl. No. 29/514,067 Response filed Aug. 22, 2016 to Non Final Office Action dated May 20, 2016 (6 pages).
U.S. Appl. No. 29/514,067, Non Final Office Action dated May 20, 2016 (20 pages).
U.S. Appl. No. 29/514,063, Response filed Oct. 24, 2016 to Non Final Office Action dated May 19, 2016 (20 pages).
U.S. Appl. No. 29/514,067, Notice of Allowance dated Sep. 20, 2016 (9 pages).
U.S. Appl. No. 29/514,070, Non Final Office Action dated May 27, 2016 (26 pages).
U.S. Appl. No. 29/514,070, Corrected Notice of Allowability dated Oct. 5, 2016 (2 pages).
U.S. Appl. No. 29/514,070, Notice of Allowance dated Sep. 21, 2016 (6 pages).
U.S. Appl. No. 29/514,073, Non Final Office Action dated May 20, 2016 (21 pages).
U.S. Appl. No. 29/514,073, Response filed Aug. 22, 2016 to Non Final Office Action dated May 20, 2016 (6 pages).
U.S. Appl. No. 29/514,073, Corrected Notice of Allowability dated Oct. 5, 2016 (2 pages).
U.S. Appl. No. 29/514,073, Notice of Allowance dated Sep. 19, 2016 (8 pages).
U.S. Appl. No. 29/514,970, Restriction Amendment filed Aug. 29, 2016 (6 pages).
U.S. Appl. No. 29/538,019, Restriction Requirement dated Sep. 1, 2016 (7 pages).
U.S. Appl. No. 29/539,391, Notice of Allowance dated Mar. 1, 2017 (8 pages).
U.S. Appl. No. 29/539,392, Notice of Allowance dated Mar. 3, 2017 (8 pages).
U.S. Appl. No. 29/539,396, Notice of Allowance dated Feb. 27, 2017 (9 pages).
U.S. Appl. No. 29/539,401, Notice of Allowance dated Feb. 27, 2017 (8 pages).
U.S. Appl. No. 29/539,405, Notice of Allowance dated Mar. 1, 2017 (9 pages).
U.S. Appl. No. 29/539,409, Notice of Allowance dated Mar. 2, 2017 (8 pages).
U.S. Appl. No. 29/539,414, Notice of Allowance dated Mar. 13, 2017 (8 pages).
U.S. Appl. No. 29/539,391, Corrected Notice of Allowability dated Mar. 31, 2017 (2 pages).
U.S. Appl. No. 29/539,415, Notice of Allowance dated Mar. 9, 2017 (8 pages).

* cited by examiner

GRILLE ATTACHMENT FEATURE FOR A VENTILATION SYSTEM

CROSS-REFERENCE TO RELATED APPLICATIONS

This application is a divisional of U.S. application Ser. No. 16/777,012 filed on Jan. 30, 2020, which claims the benefit of U.S. Provisional Patent Application No. 62/806,236, filed on Feb. 15, 2019, which applications are incorporated in their entirety herein by reference and made a part hereof.

TECHNICAL FIELD

The present disclosure relates generally to a ventilation system that is installed in a ceiling of a room to provide ventilation for the room and particularly to a ventilation system including a housing and a grille. More particularly, the present disclosure relates to an attachment feature for attaching a grille to a housing.

BACKGROUND

Conventional ventilation fans, such as those typically installed in a room of a building structure, such as a bathroom, can draw air from within an area of the room, through the fan and exhaust the air to another location, such as through a vent in the gable or roof of a home or other building structure. Many conventional ventilation fans include a housing positioned within or adjacent an aperture formed in a wall or ceiling and include a grille covering the opening to obscure view of the aperture and access to fan. Grilles are typically removable for cleaning or maintenance and may be retained to the ventilation fan using conventional grille springs. The grille springs may need to be compressed during installation of the grille. In some instances, it may be difficult to simultaneously compress the spring and position the spring in a proper location for installation. Additionally, the user may need to be elevated to reach the ventilation fan to install the grille such as, for example, when the ventilation fan is installed in a ceiling.

Therefore, a need exists for an attachment feature that allows the grille to be installed with minimal effort from the user. A full discussion of the features and advantages of the present disclosure is deferred to the following detailed description, which proceeds with reference to the accompanying drawings.

The description provided in the background section should not be assumed to be prior art merely because it is mentioned in or associated with the background section. The background section may include information that describes one or more aspects of the subject technology.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings:

FIG. 2 is a sectional view showing that the attachment feature includes a first magnetic element coupled to the housing mount and a second magnetic element coupled to the grille mount with like polarities facing one another when the grille is uninstalled from the main housing;

FIG. 3 is a sectional view of the housing mount and the grille mount moved closer to one another as the grille is being installed such that a relatively large repelling force caused by the magnetic elements acts between the housing mount and the grille mount;

FIG. 4 is a sectional view of the housing mount and the grille mount moved even closer to one another such that the housing mount is received within an opening defined by the grille mount to overcome the repelling force;

FIG. 5 is a sectional view of the housing mount and the grille mount in the installed position with arrows suggesting that the magnetic elements are again repelled from one another to retain the grille in the installed position;

FIG. 6 is a top perspective view of the grille and the attachment feature with the spring-compression link located at a mount section of the grille spring and the grille spring in an uncompressed state;

FIG. 7 is a top perspective view of the grille and the attachment feature with the spring-compression link moved away from the mount section of the grille spring and the spring-compression link engaging the grille spring to compress the grille spring;

FIG. 8 is a top perspective view of the grille and the attachment feature with the spring-compression link located at an attachment section of the grille spring and engaging the grille spring to fully compress the grille spring during installation of the grille;

FIG. 13 is a perspective view of the attachment post in a storage configuration;

FIG. 14 is a perspective view of the attachment post in an installation configuration.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

Figure 1:
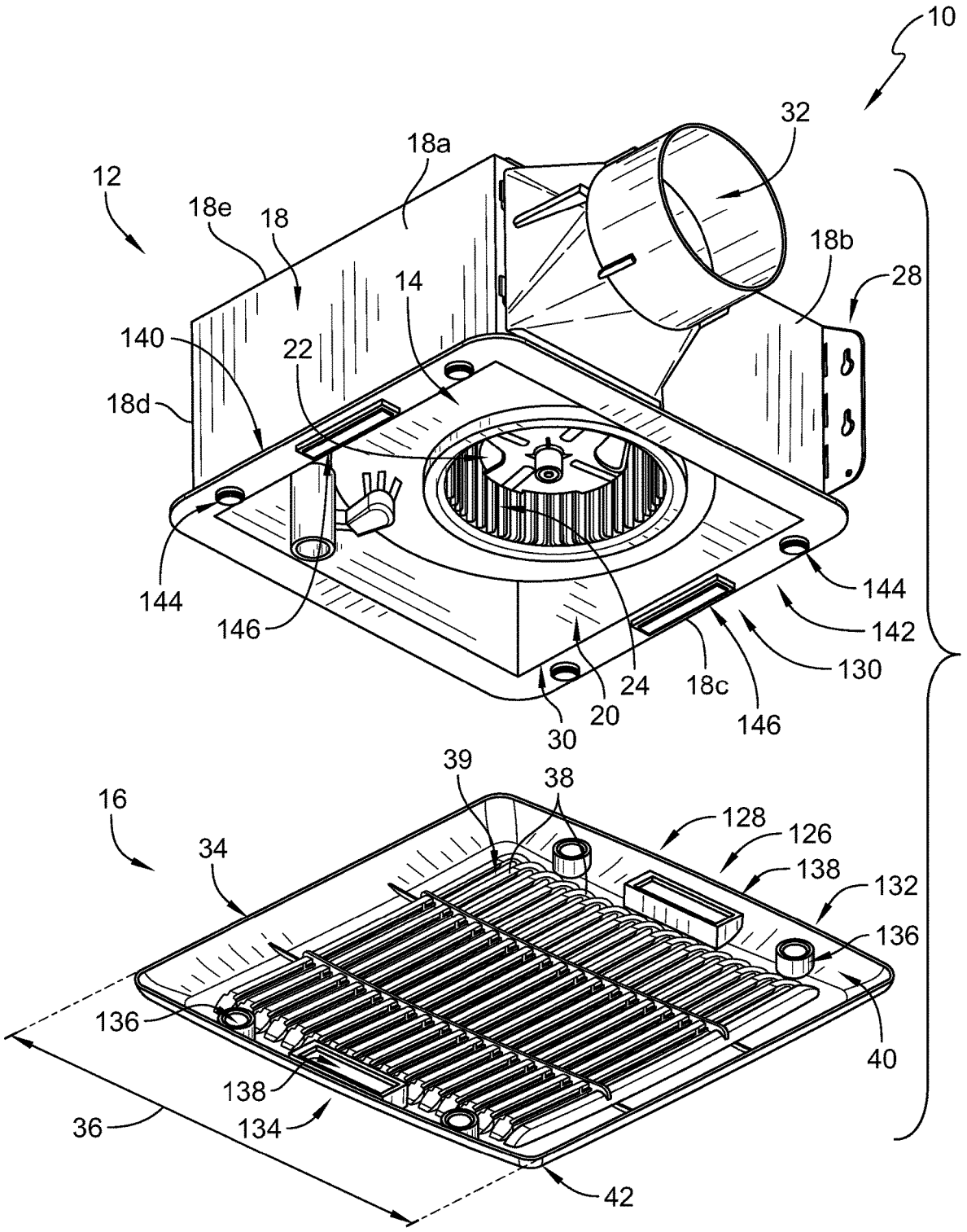
FIG. 1 is a perspective view of an exemplary embodiment of ventilation fan system, in accordance with the present disclosure, where the system includes a main housing, a blower, and a grille uninstalled from the main housing and having an attachment feature to secure the grille to the main housing.

FIG. 1 depicts one embodiment of a ventilation system 10, in accordance with the present disclosure. The ventilation system 10 is configured to be positioned in a room of a building structure to provide ventilation for the room of the building structure. For example, the ventilation system 10 may be positioned in a ceiling panel (not shown) of the room and aligned with a cutout in the ceiling panel to ventilate the room. The ventilation system 10 may include a main housing 12, a blower 14, and a grille 16. The main housing 12 has an external wall structure 18 that defines an internal region 20 to house the blower 14. The blower 14 includes a motor 22 and a bladed rotor 24 that is configured to rotate about an axis within the housing 12 and move air through the housing and provide ventilation to the room. The grille 16 is removably coupled to the main housing 12 and is configured to obscure view of, and access to, the cutout in the ceiling, the main housing 12, and the blower 14 from within the room.

In FIG. 1, the grille 16 is separated from the main housing 12 to provide access to the internal region 20 and the blower 14. Additionally, once the grille 16 is separated from the main housing, the ventilation system 10 may be retrofitted with another grille to provide the ventilation system 10 with a grille having a different configuration, a different aesthetic appearance or a grille having different features, such as lighting, sensors (e.g. occupancy, humidity or other air quality, etc.) and/or radio frequency connectivity (e.g. Bluetooth, WiFi, etc.). The ventilation system 10 further includes attachment features 126 (FIGS. 1-5), 226 (FIGS. 6-9), 326 (FIGS. 10-12), 426 (FIG. 13), 526 (FIG. 14), and 626 (FIG. 15) that make installation and removal of the grille 16 from the main housing 12 simple and ergonomic for a user.

The main housing 12 includes at least one bracket 28 adapted to secure the ventilation system 10 to the building structure to position the system 10 relative to a room to be ventilated. The bracket 28 may be shaped and sized to mate with ceiling structure, such as joist or other support member of the building structure. The external wall 18 is includes a plurality of side walls 18*a*, 18*b*, 18*c*, 18*d* and a top wall 18*e* that define the internal region 20 as shown in FIG. 1. The main housing 12 houses various components for operation of the blower 14. The main housing 12 defines an inlet opening 30 and an outlet opening 32. The inlet opening 30 is cooperatively dimensioned to align with the cutout formed in the ceiling of the room of the building structure. The outlet opening 32 is formed in a side wall 18*b* of the external wall 18 and directs discharge air toward a space outside of the internal region 20. In some embodiments, the outlet opening 32 may be fluidly coupled to a duct leading to a vent that discharges into the atmosphere outside of the building structure.

The main housing 12 can be formed of any material known to those skilled in the art capable of withstanding varying temperatures, namely to withstand any heat radiated and/or conducted from the blower 14 and/or other components while providing structural integrity to the system 10. In some embodiments, the main housing 12 is formed of sheet metal, but could instead be formed of a ceramic or a polymer having a relatively high melting temperature and/or glass transition temperature. The main housing 12 can have any shape, including a box-like or cubical shape, a hemispherical shape, a spherical shape, a pyramidal shape, and the like. The main housing 12 can form a base or frame for the ventilation system 10, thereby providing points and areas of attachment for other components of the ventilation system 10. For example, the main housing 12 can provide places of attachment for the attachment features 126, 226, 326, 426, 526, and 626, as will be described below.

In one embodiment, the blower assembly 14 is a centrifugal fan including the motor 22 and the bladed rotor 24, as is well-known to those skilled in the art. However, other types of blower assemblies can be employed as desired. Illustratively, the blower assembly 14 is located entirely within the main housing 12, however in other embodiments, the blower 14 can be in fluid communication with the main housing 12 via one or more ducts coupled to the main housing 12. In yet another embodiment, the internal region 20 may include multiple sub-cavities and the blower 14 may be located in only one of the sub-cavities.

The grille 16 is configured to couple to the main housing 12 to block view of the main housing 12 and the blower 14, thereby providing a more aesthetic appearance of the system 10 from the room to which the system 10 is connected. The grille 16 includes a peripheral trim 34 that defines an outermost dimension 36 of the grille 16 and a plurality of ribs 38 that extend between the peripheral trim 34. The outermost dimension 36 is greater than the cutout in the ceiling panel and the inlet opening 30 of the main housing 12 to obscure view of the cutout and the main housing 12 when the grille 16 is fully installed. The ribs 38 are spaced apart from one another to define apertures 39 therebetween. The apertures 39 allow air to flow between the ribs 38 and into the inlet opening 30 of the main housing 12. In the illustrative embodiment, a majority of the ribs 38 are parallel to one another while a minority of the ribs 38 extend perpendicular to the majority to provide reinforcement. In other embodiments, any suitable number and arrangement of ribs 38 or other features may be used.

In the depicted embodiments, portions of the attachment features 126, 226, 326, 426, 526, and 626 attach to the main housing 12 to facilitate retaining the grille 16 in an installed position while allowing for easy removal and/or installation of the grille 16 as described above. However, in other embodiments, the attachment features 126, 226, 326, 426, 526, and 626 may be configured to attach to another suitable structure such as an intermediate structure between the grille 16 and the main housing 12, the blower 14, or the ceiling panel.

A first embodiment of an attachment feature 126 is shown in FIGS. 1-5. The attachment feature 126 includes a plurality of magnets 128 spaced apart from one another along the peripheral trim 34 of the grille 16. A corresponding plurality of mating elements 130 are coupled to the main housing 12. In the depicted embodiment, the plurality of mating elements 130 are also magnets, however, as suggested above, the elements 130 need not be magnetic. The plurality of magnets 128 on the grille 16 and the plurality of mating elements 130 on the main housing 12 cooperate to retain the grille 16 to the housing in the installed position.

The plurality of magnets 128 include a first set of magnets 132 positioned on a first side 40 of the grille 16 and a second set of magnets 134 positioned on a second side 42 of the grille 16 opposite of the first side 40. The first and second sets of magnets 132, 134 each include a pair of circular shaped magnets 136 and a rectangular shaped magnet 138 between each of the circular shaped magnets 136. Each of the magnets 136, 138 are matched with corresponding mating elements 130 coupled to the main housing 12. The magnets 136, 138 cooperate with the mating elements 130 to locate the grille 16 relative to the main housing 12 when the grille 16 is installed.

In the depicted embodiment, the plurality of mating elements 130 include a first set of magnets 140 coupled to side wall 18*a* of the main housing 12 and a second set of magnets 142 coupled to side wall 18*c* of the main housing 12. Each of the magnets 140, 142 is coupled to the main housing 12 within the internal region 20, however, in other embodiments the magnets 140, 142 may be coupled to other areas of the main housing, an intermediate structure between the housing 12 and the grille, or the blower 14. The first and second sets of magnets 140, 142 each include a pair of circular shaped magnets 144 and a rectangular shaped magnet 146 between each of the circular shaped magnets 144.

In the depicted embodiment, the attachment feature 126 is attached to the grille 16 and the main housing 12 on only two sides of the system 10 as described above. In this arrangement, space is provided on the other two sides of the system 10 for other structures or features to be included in the system such as, for example, an additional attachment feature. However, in other embodiments, it is contemplated that the attachment feature may be arranged on all four sides of the system 10, along three sides of the system 10, or on only one side of the system 10. In yet another example, the attachment feature 126 may be located in a generally central region of the grille 16.

FIGS. 2-5 illustrate a single connection point of one of the circular shaped magnets 136 of the attachment feature 126 for being coupled to the grille 16 (not depicted in FIGS. 2-5) and the corresponding circular shaped magnet 144 of the attachment feature for being coupled to the main housing 12 (not depicted in FIGS. 2-5). The attachment feature 126 further includes a grille mount 148 carrying the circular shaped magnet 136 and a housing mount 150 carrying the circular shaped magnet 144. The grille mount 148 includes a central opening 152 that extends through the grille mount 148 from an upper surface 153 to a lower surface 155. The central opening 152 is sized to receive the housing mount 150. The housing mount 150 has an outer dimension that is slightly smaller than the central opening 152 to allow the housing mount to slide relative to the grille mount 148 through the central opening 152 from the upper surface 153 to the lower surface 155 as shown by the progressive steps depicted in FIGS. 3-5.

Figure 2:
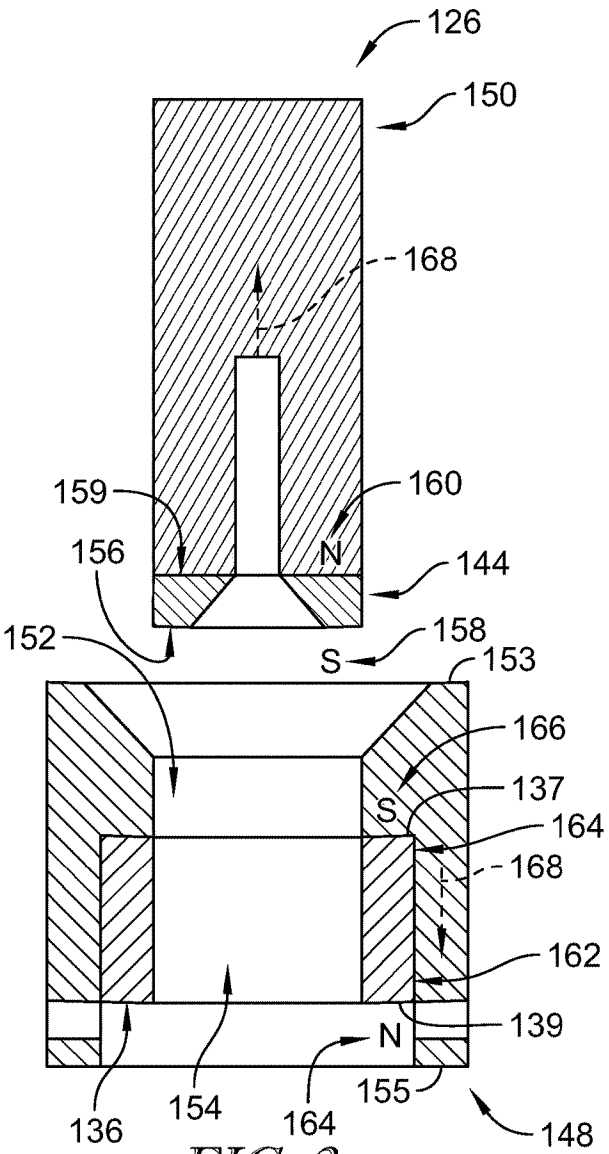

In the depicted embodiment, the magnet 136 is housed within the grille mount 148 as shown in FIG. 2. The magnet 136 includes an upper surface 137 spaced downwardly from the upper surface 153 of the grille mount 148 and a lower surface 139 spaced upwardly from the lower surface 155 of the grille mount 148. The magnet 136 also includes a corresponding central opening 154 that matches the size of the central opening 152 of the grille mount 148 to allow the housing mount 150 to slide through the central opening 154 of the magnet 136.

Installation of the grille occurs as the grille 16 is moved closer the main housing 12 such that the magnet 144 carried by the housing mount 150 translates through the central openings 152, 154 as shown in the progression of FIGS. 2-5. Although not shown in FIGS. 2-5, it should be noted that the other connection points of the attachment feature 126 include similar mounts that cooperate with one another similarly to the manner described below.

As shown in FIG. 2, the housing mount 150 is spaced apart from the grille mount 148. In this position, the grille 16 is uninstalled from the main housing 12. The magnet 144 carried by the housing mount 150 includes a lower section 156 with a first polarity 158 and an upper section 159 with a second polarity 160 opposite the first polarity 158. Conversely, the magnet 136 carried by the grille mount 148 includes a lower section 162 with a polarity 164 that matches the second polarity 160 and an upper section 165 with a polarity 166 that matches the first polarity 158. In this way, the housing mount 150 is slightly repelled away from the grille mount 148 when the grille 16 is in the uninstalled position as suggested by the arrows 168 in FIG. 2.

Figure 3:
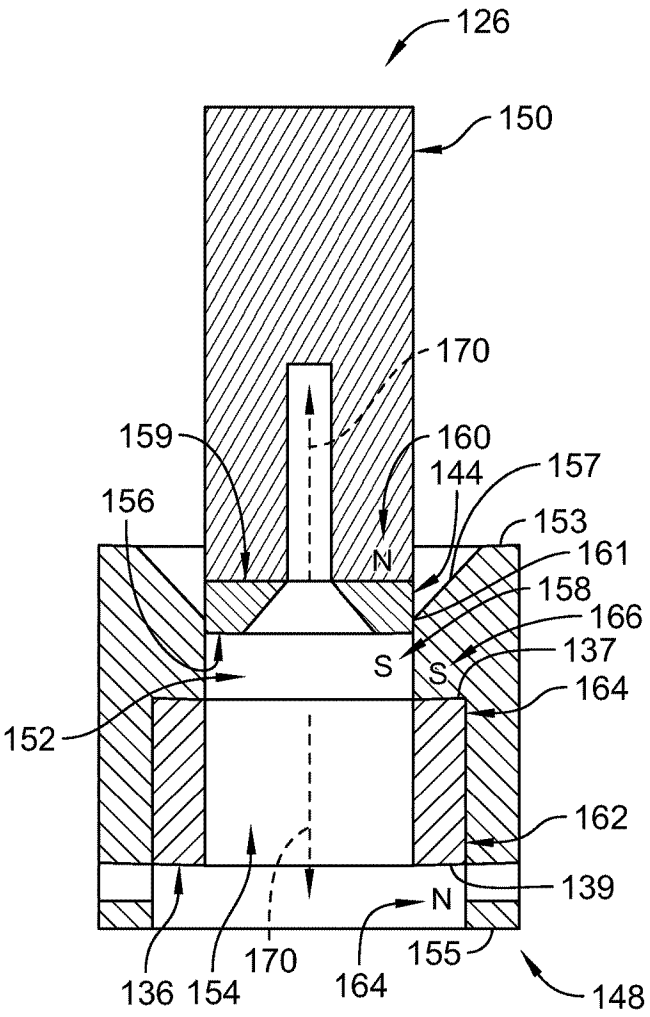
FIGS. 2-5 are a series of sectional views of a first embodiment of an attachment feature for securing the grille to the main housing illustrating how a housing mount and a grille mount cooperate to install and retain the grille to the main housing.

As shown in FIG. 3, the housing mount 150 is moved closer to the grille mount 148 to begin installation of the grille 16 on the main housing 12. The grille mount 148 further is beveled to include a sloped surface 157 that extends from the upper surface 153 at an angle to a point 161 in the central opening 152 between the upper and lower surfaces 153, 155. The sloped surface 157 guides the housing mount 150 into the central opening 152 toward the magnet 136. As the magnet 144 carried by the housing mount 150 is moved closer to the magnet 136, the repelling force between the magnets is increased as suggested by arrows 170 in FIG. 3. The point 161 is located above the magnet 136 to gradually decrease lateral movement of the housing mount 150 relative to the grille mount 148 as the magnets 136, 144 move closer together and the repelling force increases.

Figure 4:
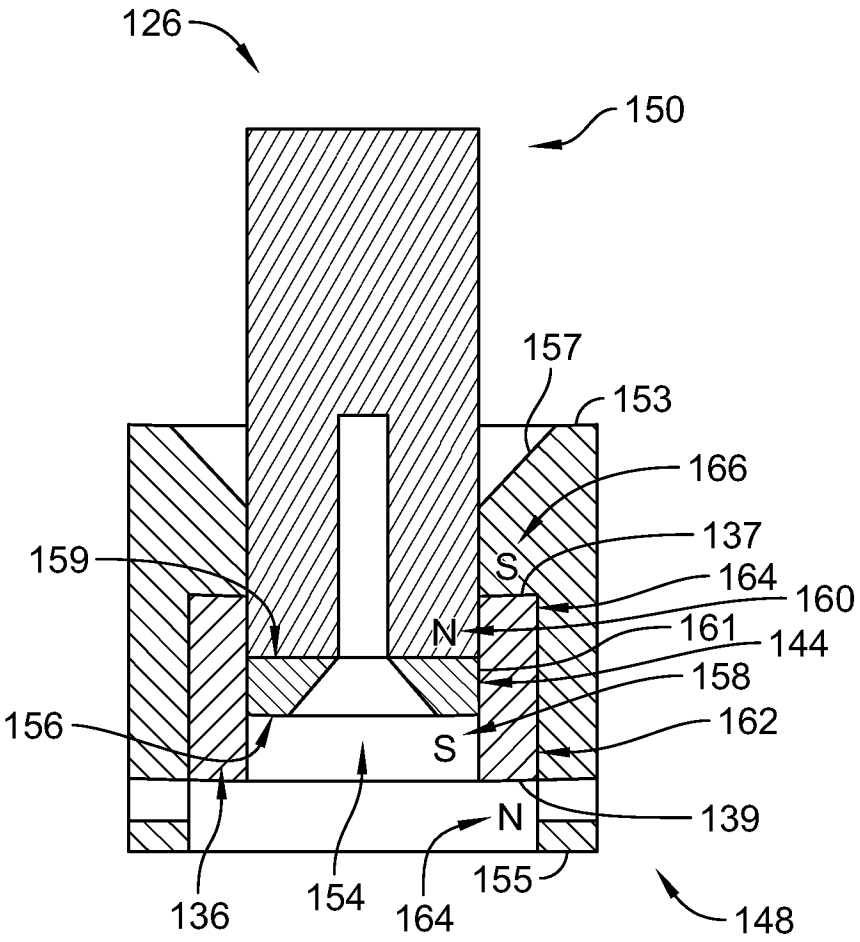

As shown in FIG. 4, the housing mount 150 is inserted even further into the central opening 152 such that the magnets 144, 136 overlap as the grille 16 is moved toward the installed position. In this position, the magnets 136, 144 are generally at equilibrium relative to one another with little or no forces acting on one another.

Figure 5:
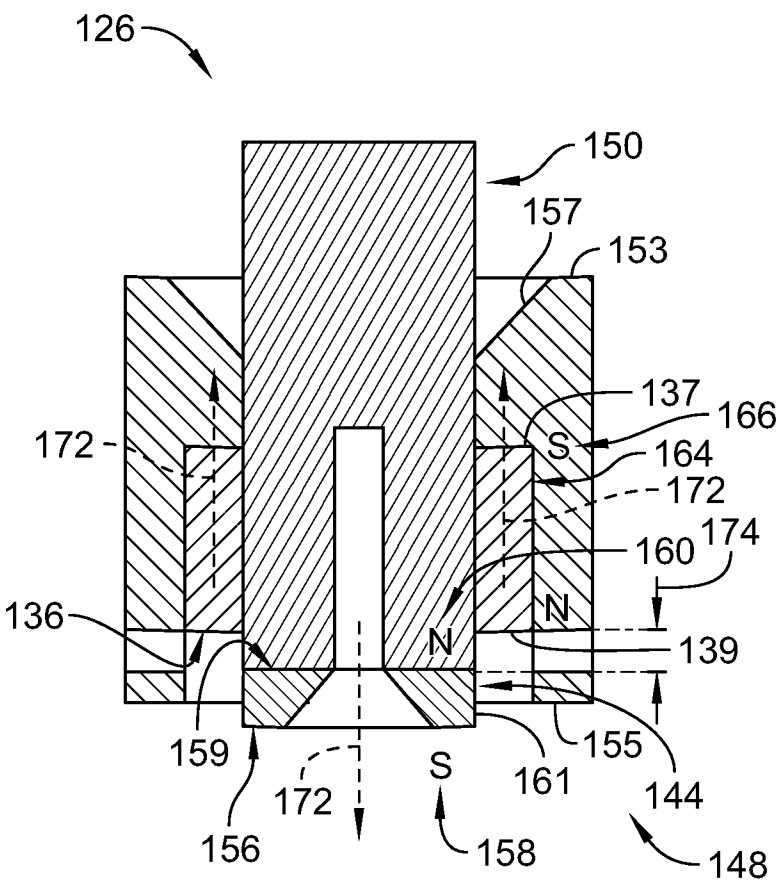

As shown in FIG. 5, the housing mount 150 is inserted even further into the central opening 152 until the magnet 144 carried by the housing mount 150 is located below the magnet 136 carried by the grille mount 148. In this position, the magnets 136, 144 again repel one another with a repelling force between the upper section 159 of the magnet 144 and the lower section 162 of the magnet 136 as suggested by arrows 172 in FIG. 5. However, in this position the repelling force retains the grille 16 to the main housing 12 to provide the installed position of the grille 16. Removal of the grille 16 may be accomplished by overcoming the repelling force described in FIG. 5. It should be noted that in other embodiments, the housing mount 150 and the grille mount 148 may be switched such that the mount 150 is coupled to the grille 16 and the mount 148 is coupled to the housing 12.

The attachment feature 126 compensates for misalignments between the main housing 12 and the ceiling panel. For example, if the main housing 12 is improperly installed such that the main housing 12 is angled relative the ceiling panel, the attachment feature 126 aligns the grille 16 with the ceiling panel. This eliminates unaesthetic gaps between the grille 16 and the ceiling panel and allows the grille 16 to cover the misaligned housing 12 to improve overall aesthetics for the system 10. In the installed position, the magnet 144 of the housing mount 150 is spaced apart from the magnet 136 of the grille mount 148 by a tolerance space 174 as shown in FIG. 5. The tolerance space 174 may be increased or decreased for each connection point of the attachment feature 126 depending on the alignment of the main housing 12 with the ceiling panel. Other magnetic connections using attraction forces may not be able to provide the tolerance space 174 to compensate for misalignments.

Figure 6:
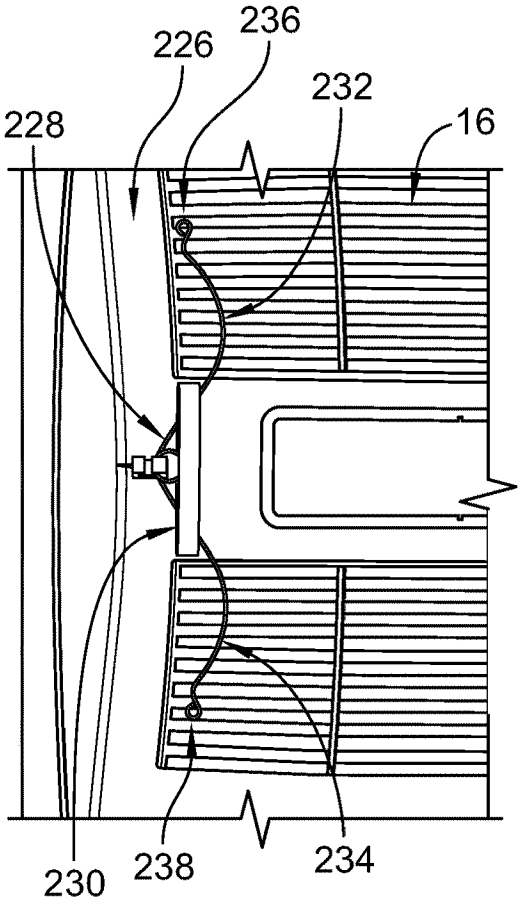
FIGS. 6-8 are a series of top perspective views of a second embodiment of an attachment feature including a grille spring and a spring-compression link movable along the grille spring and configured to retain the grille spring in a compressed state during installation of the grille.
Figure 7:
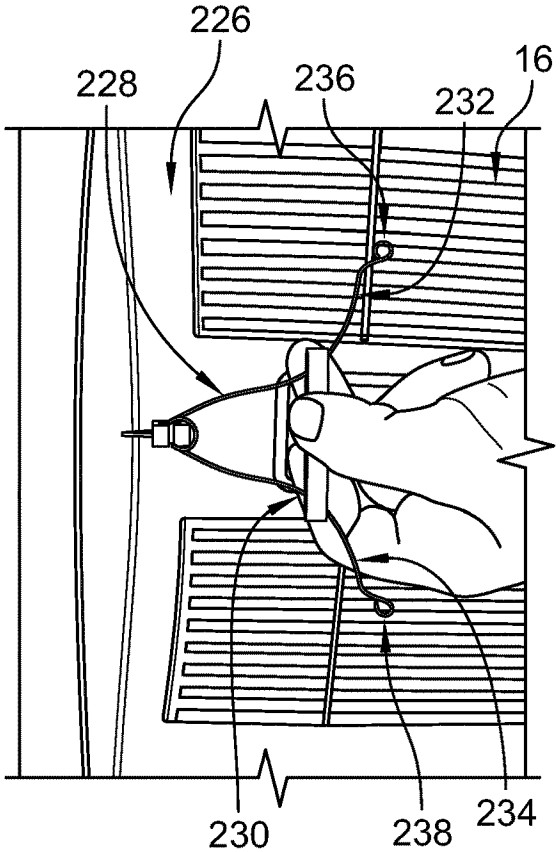
Figure 8:
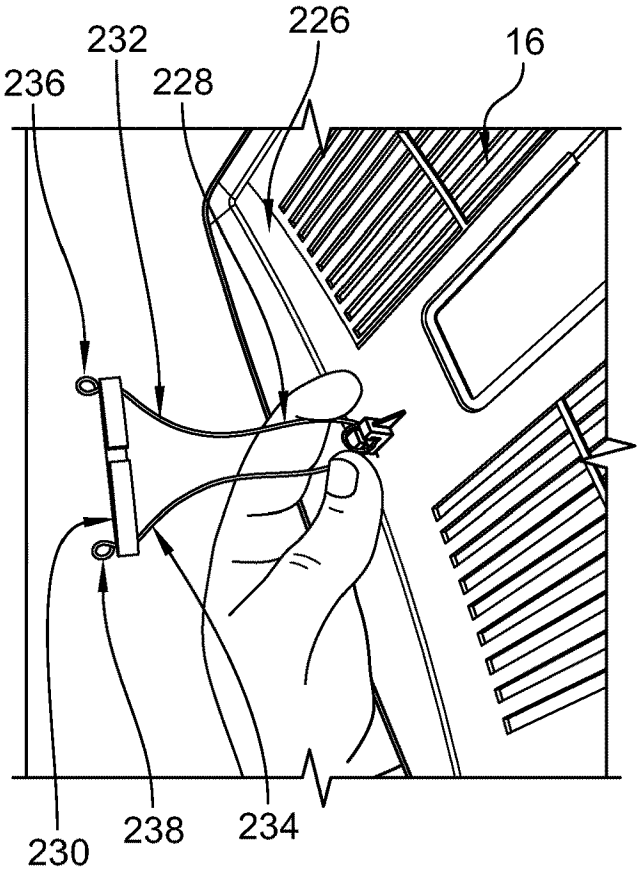

A second embodiment of an attachment feature 226 is shown in FIGS. 6-9. The second attachment feature 226 includes a grille spring 228 and a spring-compression link 230 that is configured to retain the grille spring 228 in a compressed state during installation of the grille 16 as shown in FIG. 8. The grille spring 228 is coupled to the grille 16 and includes a pair of flexible arms 232, 234 that extend outwardly away from one another. During installation of a grille that includes a grille spring 228 without the spring-compression link 230, the arms 232, 234 are pinched together by the user as shown in FIG. 7 until the grille spring 228 reaches the compressed state. Distal ends 236, 238 of the grille spring 228 are then inserted into a slot (not shown) or coupled to tabs (not shown) in the main housing 12. The grille is then pushed upwardly toward the main housing 12 and the arms 232, 234 flare outwardly to bias and retain the grille 16 to the main housing 12. The spring-compression link 230 facilitates installation of the grille 16 by retaining the grille spring 228 in the compressed state during installation so that the user can couple the distal ends 236, 238 to the main housing 12 without simultaneously pinching the arms 232, 234 together.

Figure 9:
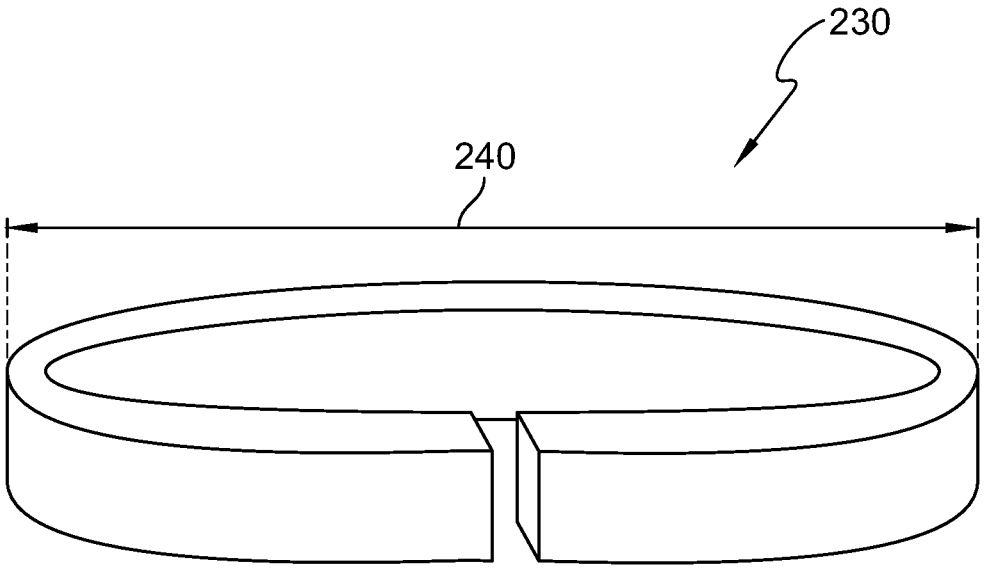
FIG. 9 is an enlarged perspective view of one embodiment of the spring-compression link of FIGS. 6-8.

As depicted in FIG. 9, the depicted embodiment of the spring-compression link 230 comprises a band that forms a generally elongated oval shape. In one embodiment, the spring-compression link 230 is comprised of an elongated band with opposing ends of the band folded to be adjacent one another, as depicted in FIG. 9. The spring-compression link 230 can be comprised any known material. In one example, the spring-compression link 230 is comprised of a metal band. In an alternative embodiment, the spring-compression link 230 is comprised of a polymer chosen to readily slide along the grille spring 228. The spring-compression link 230 can be of rectangular cross-section (as depicted) or another suitable cross-section.

This band wraps around each of the grille spring arms 232, 234 as shown in FIGS. 6-8. The spring-compression link 230 has a length 240 that is sized to align the distal ends 236, 238 of the grille spring 228 with the corresponding structure in the main housing 12 that the arms 232, 234 attach to, such as the slot or tabs described above. Any suitable length 240 may be used depending on the type and size of structure included in the main housing 12 for attaching the grille spring 228.

In use, the spring-compression link 230 is translated relative to (i.e. slid along) the arms 232, 234 toward the distal ends 236, 238 as shown in FIGS. 6-8. The spring-compression link 230 pre-compresses the arms 232, 234 together as described above so that additional compression forces from the user are not needed during installation. The grille spring 228 and the spring-compression link 230 may then be positioned into contact with the structures on the main housing 12 that retain the grille spring 228. As the distal ends 236, 238 of the arms 232, 234 are inserted into their respective slots, a portion of the main housing 12 may contact the spring-compression link 230 to move the spring-compression link 230 away from the distal ends 236, 238. As the spring-compression link 230 is moved away from the ends 236, 238, the arms 232, 234 flare outwardly to secure the grille spring 228 and the grille 16 to the main housing, preferably with the grille contacting the ceiling.

Figure 10:
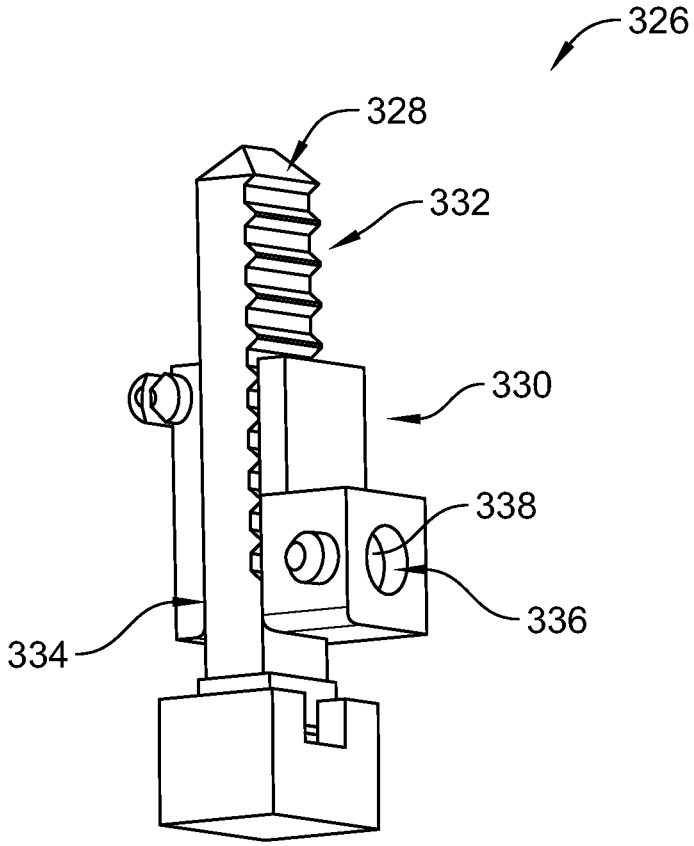
FIG. 10 is a perspective view of a third embodiment of an attachment feature for the grille including an attachment post with a plurality of teeth disposed along a length of the post and a corresponding attachment retainer configured to engage the teeth to secure the grille to the main housing.

FIGS. 10-13 illustrate various embodiments of attachment features 326, 426, and 526 that use similar key-and-slot structures to secure the grille 16 to the main housing 12. A third embodiment of an attachment feature 326 is shown in FIG. 10. The attachment feature 326 includes an attachment post 328 adapted to be coupled to the grille 16 and an attachment retainer 330 adapted to be coupled to the main housing 12. The attachment post 328 includes a plurality of teeth 332 formed on at least one surface of the attachment post 328. The attachment retainer 330 includes a vertical slot 334 that is sized to receive the attachment post 328 to couple the grille 16 to the main housing 12. It should be noted that the attachment post 328 and the attachment retainer 330 are interchangeable with respect to the grille 16 and the housing 12.

The attachment retainer 330 further includes a horizontal slot 336 that extends generally perpendicular to the vertical slot 334 as shown in FIG. 10. The horizontal slot 336 is sized to receive a detent structure 338 that is configured to engage the attachment post 328. The plurality of teeth 332 face toward the horizontal slot 336 and interact with the detent structure 338 to secure the grille 16 to the main housing 12. The detent structure 338 applies a force on the attachment post 328 to block movement of the attachment post 328 until a user overcomes the force. The detent structure 338 may interact with any of the teeth 332 along the length of the attachment post 328 to control the position of the grille 16 relative to the main housing 12 or to compensate for misalignments of the housing relative to the ceiling panel.

Figure 11:
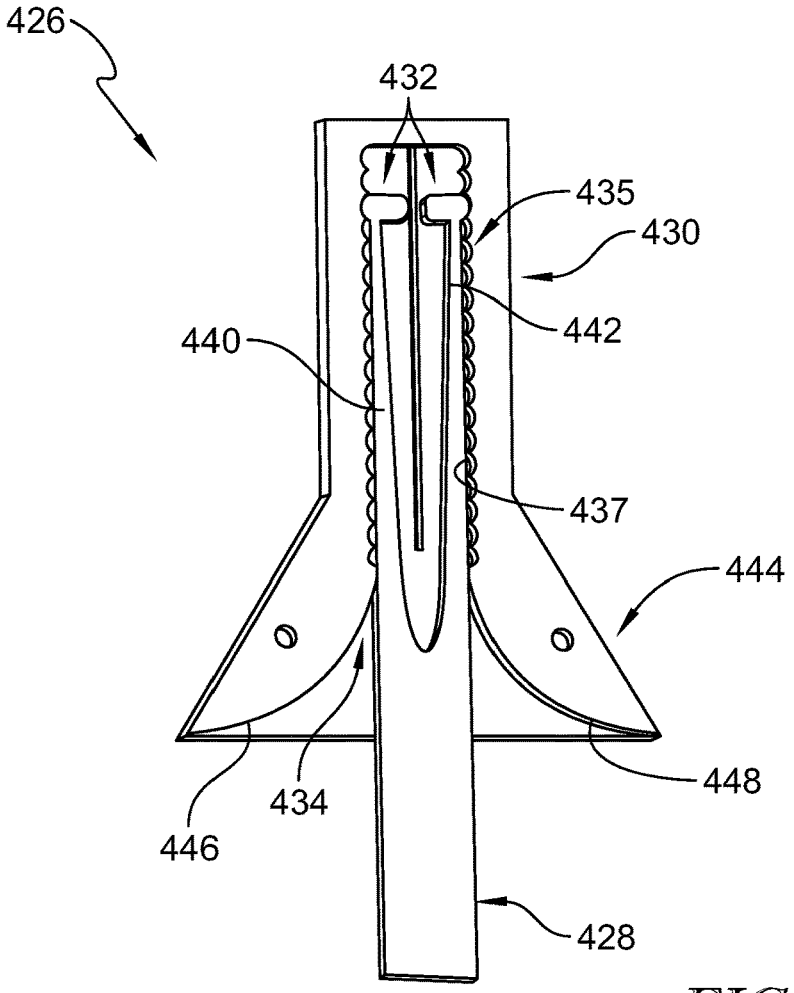
FIG. 11 is a perspective view of a fourth embodiment of an attachment feature for the grille.

A fourth embodiment of an attachment feature 426 for the grille 16 is shown in FIG. 11. The attachment feature 426 includes an attachment post 428 adapted to be coupled to the grille 16 and an attachment retainer 430 adapted to be coupled to the main housing 12. The attachment post 428 includes at least one key 432. The attachment retainer 430 includes a vertical slot 434 that is sized to receive the attachment post 428 to couple the grille 16 to the main housing 12. The attachment retainer 430 further includes a plurality of teeth 435 formed along an inner wall 437 of the vertical slot 434. It should be noted that the attachment post 428 and the attachment retainer 430 are interchangeable with respect to the grille 16 and the housing 12.

The at least one key 432 is configured to engage the plurality of teeth 435 during installation of the grille 16. The at least one key 432 applies a force on the attachment retainer 430 between adjacent teeth 435 to block removal of the attachment post 328 from the slot 434 until a user overcomes the force. The at least one key 432 may interact with any of the teeth 435 along the length of the inner wall 437 to control the position of the grille 16 relative to the main housing 12 or to compensate for misalignments of the housing relative to the ceiling panel.

In the illustrative embodiment, the attachment post 428 defines a fork that includes a first tong 440 with a key 432 and a second tong 442 with a key 432. Each of the keys 432 engage corresponding teeth 435 as the attachment post 428 is inserted into the slot 434. The first and second tongs 440, 442 are configured to flex inwardly toward one another as the keys 432 move along the teeth 435. In this way, the attachment post 428 applies a force on the attachment retainer 430.

The attachment retainer 430 further includes a guide 444 that locates the attachment post 428 relative to the slot 434. The guide 444 includes a first curved surface 446 and a second curved 448 surface opposite the first curved surface 446. Each of the curved surfaces 446, 448 are joined with the inner wall 437 of the slot 434 to direct the attachment post 428 into the slot 434. Although not shown in FIG. 10, attachment feature 326 may include a similar guide.

Figure 12:
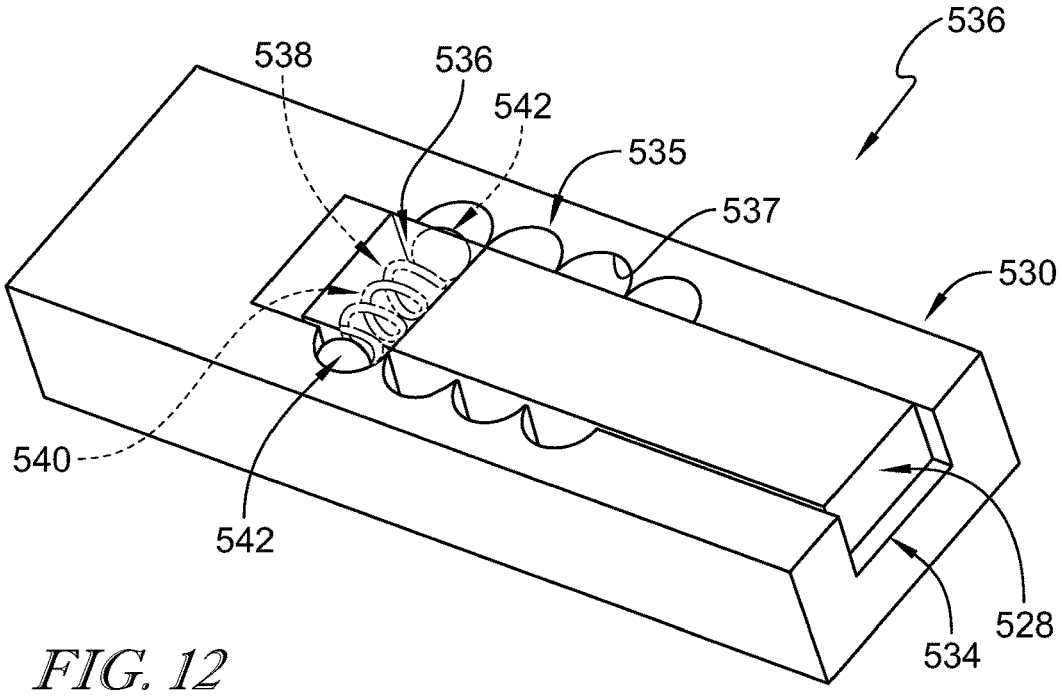
FIG. 12 is a perspective view of a fifth embodiment of an attachment feature for the grille.

In a fifth embodiment, an attachment feature 526 is shown in FIG. 12. The attachment feature 526 includes an attachment post 528 adapted to be coupled to the grille 16 and an attachment retainer 530 adapted to be coupled to the main housing 12. The attachment retainer 530 includes a vertical slot 534 that is sized to receive the attachment post 528 to couple the grille 16 to the main housing 12. The attachment retainer 530 further includes a plurality of teeth 535 formed along an inner wall 537 of the vertical slot 534. It should be noted that the attachment post 528 and the attachment retainer 530 are interchangeable with respect to the grille 16 and the housing 12.

The attachment post 528 includes a horizontal slot 536 that receives a detent structure 538 therein. In the illustrative embodiment, the detent structure 538 includes a spring 540 and a pair of caps 542 coupled with the spring 540 at respective ends of the spring 540. The spring 540 biases the caps 542 outwardly and into engagement with the inner walls 537 of the slot 534 between adjacent teeth 535. The teeth 535 cooperate with the detent structure 538 to retain the attachment post 528 in the slot 534 until the user applied a force sufficient to overcome the spring 540 and remove the attachment post 528 from the attachment retainer 530. Although not shown in FIG. 12, attachment feature 526 may include a similar guide to that shown in FIG. 11 and described above.

Figure 13:
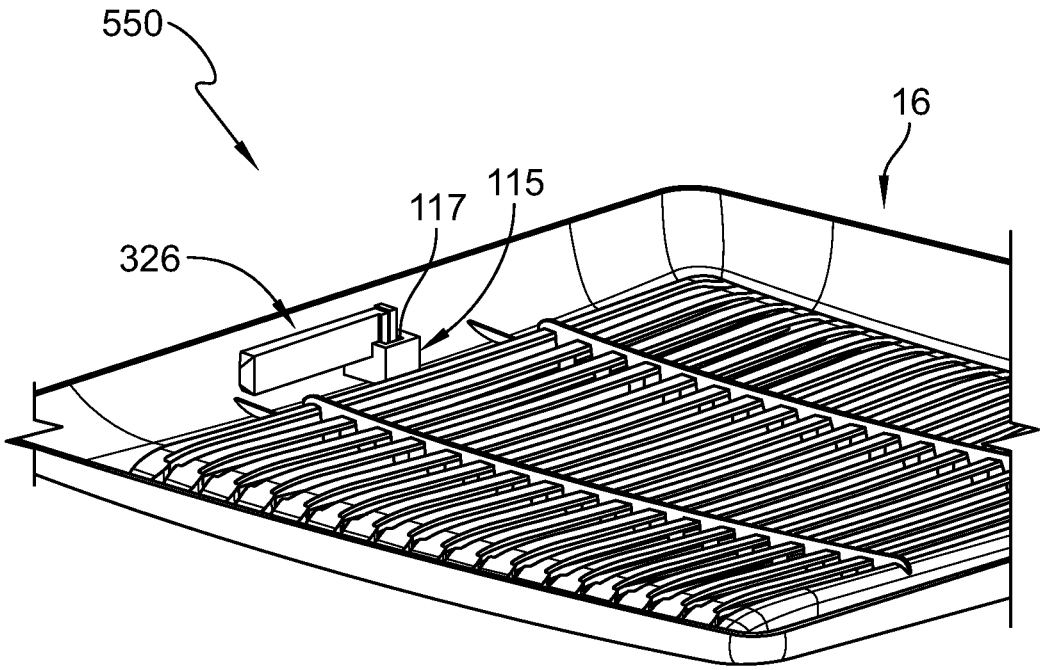
FIGS. 13 and 14 are a series of perspective views of the attachment post of the third attachment feature in FIG. 10 showing how the attachment feature may be stored on the grille for shipping and then removed and reattached in a different position for installation of the grille.
Figure 14:
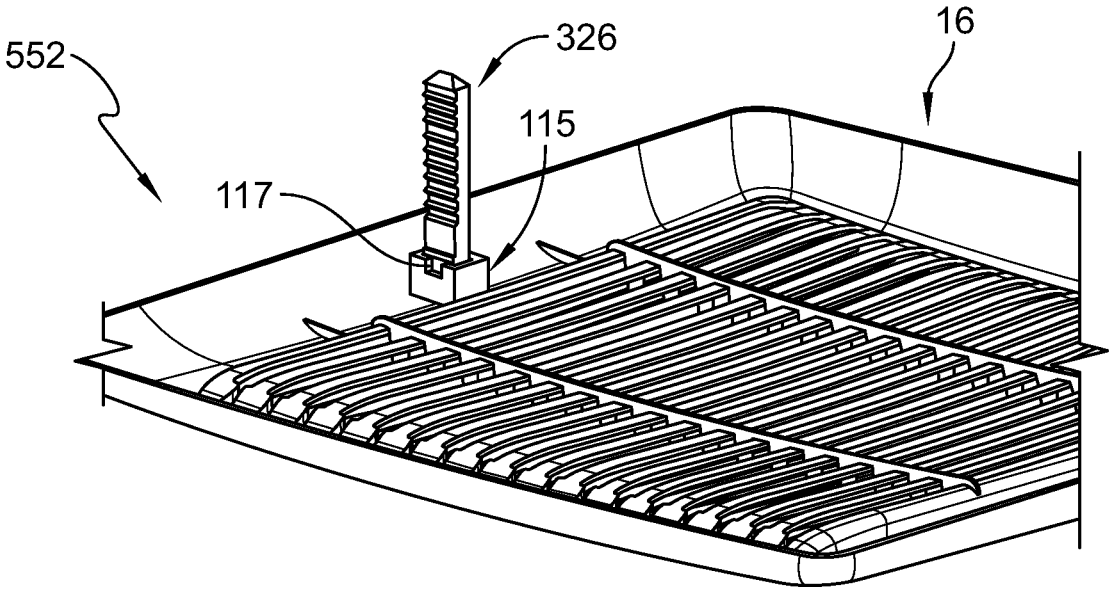

Each of the attachment posts 328, 428, 528 may be removed from the grille 16 for storage and/or shipping as shown in FIGS. 13 and 14. The grille 16 includes a base 115 that permanently coupled to the grille 16. The base 115 includes a slot 117 that is sized to removably couple the attachment posts 328, 428, 528 to the grille 16. The attachment posts 328, 428, 528 may include a corresponding size and shape that allows the posts 328, 428, 528 to translate into the slot 117 from multiple orientations and to retain the posts 328, 428, 528 in those orientations. For example, the posts 328, 428, 528 be delivered in storage position 550 in which the posts 328, 428, 528 are generally parallel to the grille 16 to make the overall thickness of the grille 16 smaller for storage and/or shipping as shown in FIG. 13. When the grille 16 is ready for installation, the posts 328, 428, 528 may be removed from their storage position and reattached to the base 115 in an installation position 552 in which the posts 328, 428, 528 are generally perpendicular to the grille 16 as shown in FIG. 14.

Figure 15:
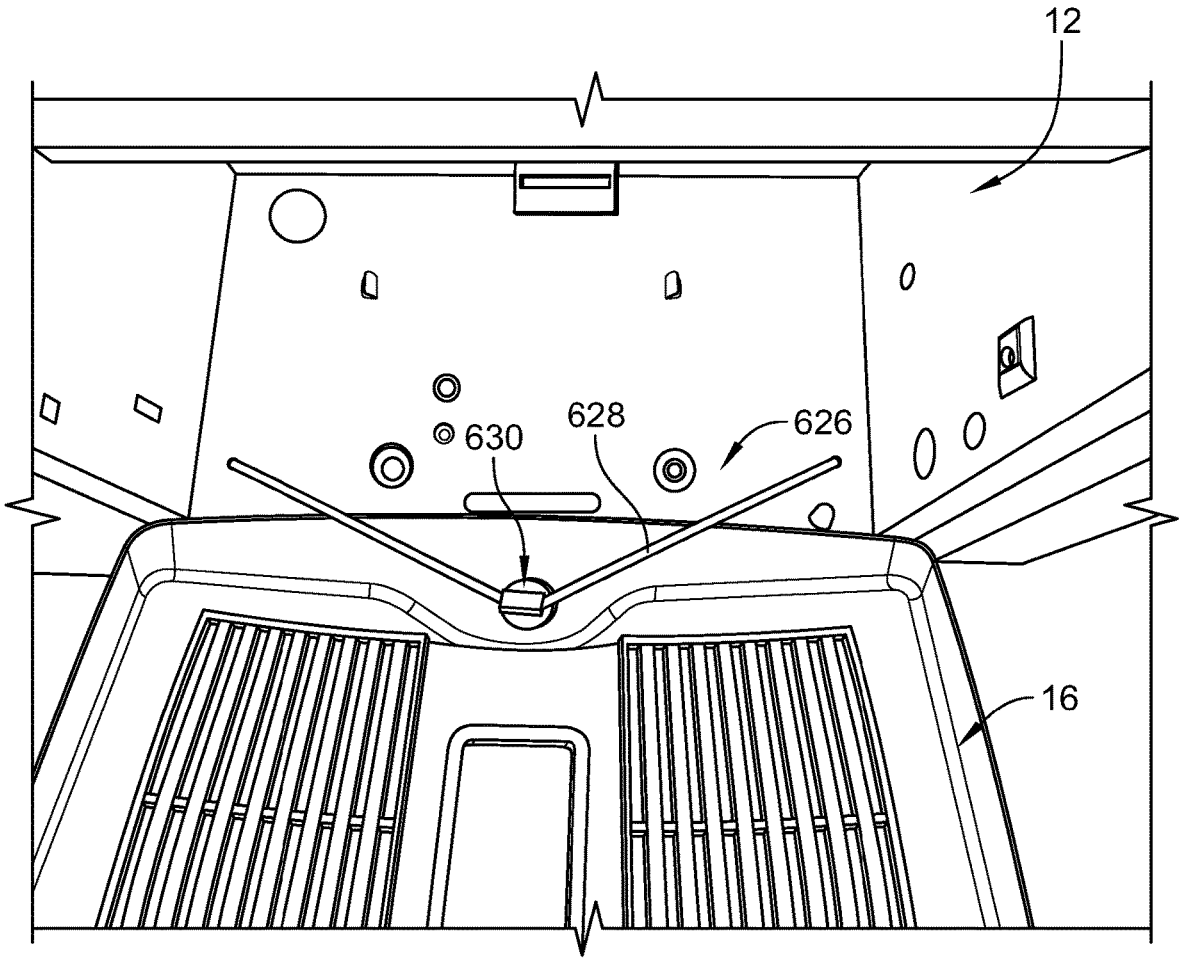
FIG. 15 is a perspective view of a sixth embodiment of an attachment feature for the grille including an elastic band coupled to the main housing and an attachment hook coupled to the grille and configured to receive the elastic band to secure the grille to the main housing.

Attachment feature 626 for the grille 16 is shown in FIG. 15. The attachment feature 626 includes an elastic band 628 and an attachment hook 630. In the illustrative embodiment, the elastic band 628 is coupled to the main housing 12 and the attachment hook 630 is coupled to the grille 16 and configured to receive the elastic band 628 to secure the grille 16 to the main housing 12. The elastic band 628 is flexible and includes a predetermined length that designed to bias the grille upwardly into engagement with the ceiling panel. Although only one elastic band is shown in FIG. 15, an additional elastic band and attachment hook may be provided on an opposite side of the grille 16 to bias the opposite side of the grille 16 into engagement with the ceiling panel. Alternatively, any other type of attachment feature could be used on the opposite side of the grille 16. Additionally, the elastic band 628 could instead be any type of spring.

While preferred embodiments have been described above and illustrated in the accompanying drawings, it will be evident to those skilled in the art that modifications may be made without departing from this disclosure. Such modifications are considered as possible variants comprised in the scope of the disclosure. Headings and subheadings, if any, are used for convenience only and do not limit the disclosure. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The use of the terms "a" and "an" and "the" and "said" and similar references in the context of describing the disclosure (especially in the context of the following claims) are to be construed to cover both the singular and the plural, unless otherwise indicated herein or clearly contradicted by context. An element proceeded by "a," "an," "the," or "said" does not, without further constraints, preclude the existence of additional same elements. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

We claim:

1. A ventilation system comprising a main housing defining an internal region configured to be positioned adjacent to a room of a building structure, a blower coupled to the main housing and configured to draw air out of the room of the building structure, and a grille configured to at least partially block view of the blower and comprising an attachment feature, the attachment feature configured to be removably coupled to at least one of the main housing and the blower, the attachment feature including:

a grille spring comprising a pair of arms, and a spring-compression link coupled to both of the arms and configured to slide relative to the arms and to move the grille spring from an uncompressed state, in which the arms flare outwardly from one another, and a compressed state, in which the arms moved closer to one another and retained in the compressed state by the spring-compression link prior to installation of the grille.

2. The system of claim 1, wherein the at least one of the main housing and the blower include a structure that engages the spring-compression link during installation of the grille to move the spring-compression link and change the grille spring from the compressed state to the uncompressed state.

3. The system of claim 1, wherein the spring-compression link includes a rectangular band that forms an elongated oval shape and wraps around each of the arms of the grille spring.

4. The system of claim 1, wherein the spring-compression link has a predetermined length that is sized to align the arms with a corresponding attachment structure included in the at least one of the main housing and the blower when the spring-compression link retains the grille spring in the compressed state.

5. The system of claim 1, wherein the grille spring arms are biased away from each other.

6. A ventilation system comprising a main housing defining an internal region, a blower coupled to the main housing, a grille configured to be removably coupled to at least one of the main housing and the blower, the grille comprising: (a) a grille spring coupled to the grille, the grille spring comprising a pair of flexible arms configured to removably couple the grille to at least one of the main housing and the blower, and (b) a spring-compression link coupled to both of the pair of flexible arms, wherein the spring-compression link is configured to slide relative to the pair of flexible arms to move the grille spring between an uncompressed state, in which the arms flare outwardly from one another, and a compressed state, in which the arms are closer to one another than in the uncompressed state, and retained in the compressed state by the spring-compression link.

7. The ventilation system of claim 6, wherein the at least one of the main housing and the blower include a structure that engages the spring-compression link during installation of the grille to move the spring-compression link and change the grille spring from the compressed state to the uncompressed state.

8. The ventilation system of claim 6, wherein the spring-compression link comprises a band that forms an elongated oval shape and wraps around each of the flexible arms.

9. The ventilation system of claim 6, wherein the spring-compression link defines a length that is sized to align the pair of flexible arms with a corresponding attachment structure included in the at least one of the main housing and the blower when the spring-compression link retains the grille spring in the compressed state.

10. The ventilation system of claim 6, wherein the spring-compression link wraps around each of the pair of flexible arms.

11. The ventilation system of claim 6, wherein the flexible arms are biased away from each other.

12. The ventilation system of claim 6, wherein the grille is configured to at least partially block view of the blower.

13. The ventilation system of claim 6, wherein the main housing defines an attachment structure to receive distal ends of the pair of flexible arms.

14. A grille configured for a ventilation system having a main housing defining an internal region and a blower located in the internal region, the grille configured to be removably coupled to at least one of the main housing and the blower, the grille comprising:

a grille spring coupled to the grille, the grille spring comprising a pair of flexible arms configured to removably couple the grille to at least one of the main housing and the blower, and a spring-compression link wrapped around each of the pair of flexible arms.

15. The grille of claim 14, wherein the spring-compression link is configured to slide relative to the pair of flexible arms to move the grille spring between an uncompressed state, in which the arms flare outwardly from one another, and a compressed state, in which the arms are closer to one another than in the uncompressed state.

16. The grille of claim 14, wherein the spring-compression link comprises a band that forms an elongated oval shape.

17. The grille of claim 14, wherein the spring-compression link defines a length that is sized to align the pair of flexible arms with a corresponding attachment structure of at least one of the main housing and a blower.

18. The grille of claim 14, wherein the flexible arms are biased away from each other.

19. The grille of claim 14, wherein the grille is configured to at least partially block view of a blower.

20. The grille of claim 14, wherein the grille spring arms are biased away from each other and the spring-compression link is configured to retain the flexible arms in a compressed state.

* * * * *